US006457325B1

(12) United States Patent
Vetter

(10) Patent No.: US 6,457,325 B1
(45) Date of Patent: Oct. 1, 2002

(54) REFRIGERATION SYSTEM WITH PHASE SEPARATION

(75) Inventor: Frank Vetter, Franksville, WI (US)

(73) Assignee: Modine Manufacturing Company, Racine, WI (US)

( * ) Notice: Subject to any disclaimer, the term of this patent is extended or adjusted under 35 U.S.C. 154(b) by 14 days.

(21) Appl. No.: 09/702,349

(22) Filed: Oct. 31, 2000

(51) Int. Cl.[7] ..... F25B 43/02
(52) U.S. Cl. ..... 62/473; 62/503; 62/513
(58) Field of Search ..... 62/473, 470, 471, 62/84, 503, 509, 192, 513, 113

(56) References Cited

U.S. PATENT DOCUMENTS 3,201,949 A * 8/1965 Kocher ..... 62/192
3,494,146 A * 2/1970 Valbjorn ..... 62/473
3,850,009 A * 11/1974 Villadsen ..... 62/473
4,187,695 A * 2/1980 Schumacher ..... 62/503
4,282,717 A * 8/1981 Bonar, II ..... 62/84
4,341,086 A 7/1982 Ishii
4,972,676 A 11/1990 Sakai
5,007,247 A 4/1991 Danig
5,036,680 A 8/1991 Fujiwara et al.
5,056,329 A 10/1991 Wilkinson
5,619,861 A 4/1997 Yamanaka et al.
5,704,215 A * 1/1998 Lord et al. ..... 62/84
5,996,360 A 12/1999 Tanaka et al.
5,996,372 A 12/1999 Koda et al.
6,250,099 B1 * 6/2001 Furuya et al. ..... 62/473

* cited by examiner

*Primary Examiner*—Denise L. Esquivel
*Assistant Examiner*—Marc Norman
(74) *Attorney, Agent, or Firm*—Wood, Phillips, Katz, Clark & Mortimer

(57) ABSTRACT

High pressure drop and evaporator inefficiency due to the presence of lubricant in a refrigerant are avoided in a refrigeration system including a compressor (10) having an inlet (12) and an outlet (14). A gas cooler/condenser (16) receives compressed, lubricant containing refrigerant from the compressor outlet (14). Also included is an evaporator (48) for evaporating refrigerant and cooling another fluid and returning the refrigerant to the compressor inlet (12). A phase separator (36) is interposed between the gas cooler/condenser (16) and the evaporator (48) for receiving cooled refrigerant from the gas cooler/condenser (16). The phase separator (36) includes a chamber (62) having an inlet (34) connected to the gas cooler/condenser (16), an upper vapor outlet (38) connected to the compressor inlet (12), a liquid refrigerant outlet (40) and a lubricant outlet (78). A lubricant conduit (74) is connected to the lubricant outlet (78) and to the compressor inlet (12) for delivering lubricant separated in the phase separator (36) to the compressor (10) for lubrication purposes and a bypass conduit 42 is connected to the vapor outlet 38 and to the compressor inlet (12) to deliver the vapor stream to the compressor (10).

13 Claims, 1 Drawing Sheet

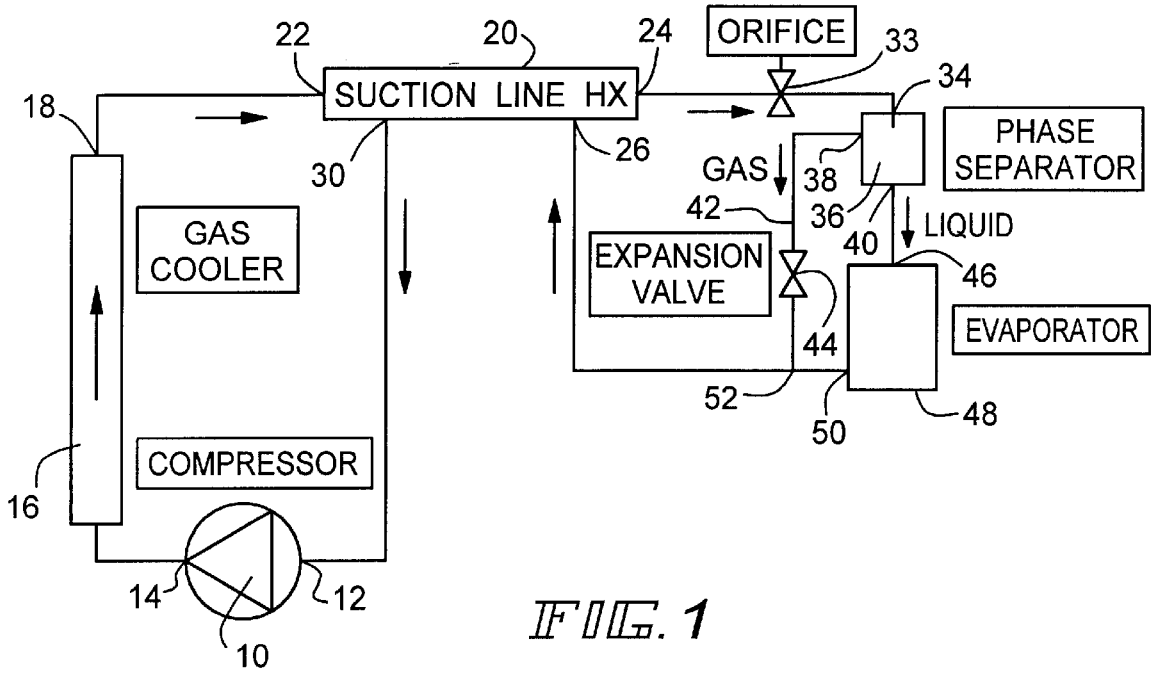
FIG. 1
FIG. 2
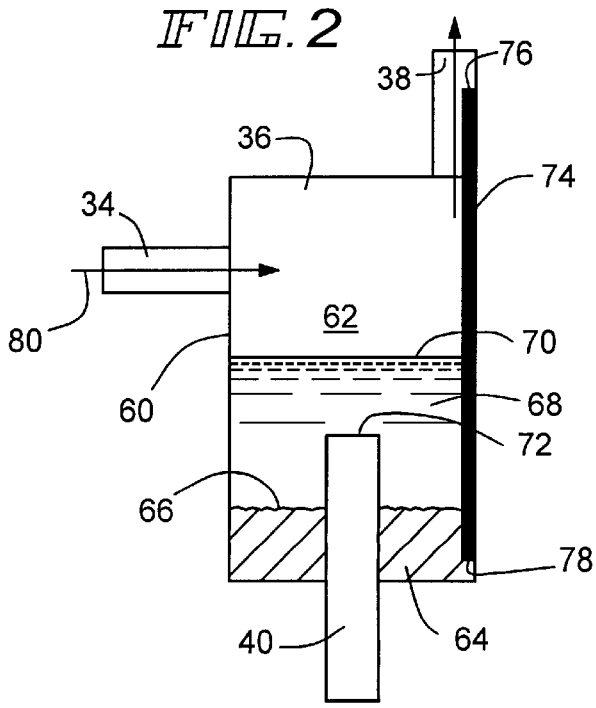

REFRIGERATION SYSTEM WITH PHASE SEPARATION

FIELD OF THE INVENTION

This invention relates to vapor compression refrigeration systems used for refrigeration and/or air conditioning purposes, whether or not employed as part of heat pump systems.

BACKGROUND OF THE INVENTION

State of the art refrigeration systems operating on the vapor compression cycle conventionally feed the evaporator with refrigerant that is in both the liquid phase and the vapor phase. In a typical system, the vapor phase refrigerant is about 30% of the total mass flow rate. Inasmuch as refrigerant vapor has a lower density than liquid refrigerant, a higher speed of the mixture is required when the mass flow rate is kept constant if the percentage of the mixture in the vapor phase is increased. This leads to a higher pressure drop inside the conduits in the evaporator than would be the case for a liquid or a two phase fluid where a lesser percentage of the total mass flow rate was in the vapor phase.

As is well known, high pressure drops are highly undesirable in systems operating on the vapor compression cycle. High pressure drops lead to heat exchange inefficiency,the requirement for oversized heat exchangers with flow paths of a larger total cross sectional area to minimize the pressure drop, increased compressed energy costs and the like.

To solve these difficulties, it has been proposed in, for example, U.S. Pat. No. 4,341,086 issued Jul. 27, 1982 to Ishii to employ a phase separator located downstream of an expansion device that in turn receives compressed refrigerant from the condenser or gas cooler of the system. The phase separator provides liquid refrigerant to the evaporator and provides for bypassing of the evaporator by the vapor phase. Consequently, the velocity of the refrigerant through the vapor is considerably reduced because only liquid phase refrigerant is entering it. In addition, there may be improved distribution of refrigerant on the inlet side of the evaporator leading to increased efficiency of the evaporator.

However, and as is also well known, it is conventional to employ a lubricant in the refrigerant to provide lubrication of the compressor during system operation. In the Ishii system, and those like it, the lubricant is frequently dissolved in the liquid refrigerant or of a density much more closely approaching the density of the liquid refrigerant than the refrigerant vapor and as a consequence is fed through the evaporator with the liquid refrigerant. The lubricant can adversely affect heat exchange within the evaporator and thus some of the advantages of phase separation taught by Ishii are lost.

U.S. Pat. No. 5,996,372 issued Dec. 7, 1999 to Koda et al. discloses the use of an accumulator intended for use in a refrigeration system and which provides a means for separating lubricant. However, the use of the accumulator at a particular location in a system to achieve maximum efficiency is not particularly well described. Moreover, the accumulator itself, with its provision for oil separation is unduly complicated and costly.

The present invention is directed to overcoming one or more of the above problems.

SUMMARY OF THE INVENTION

It is the principal object of the invention to provide a new and improved refrigeration system. More specifically, it is an object of the invention to provide such a system with a means for separating refrigerant into liquid and vapor phases before it is flowed to an evaporator along with provision for assuring that lubricant contained within the refrigerant is constantly circulated to prevent lack of lubrication of the compressor during operation.

An exemplary embodiment of the invention achieves the foregoing objects in a structure including a compressor having an inlet and an outlet. A heat exchanger is provided for receiving compressed, lubricant containing refrigerant from the compressor outlet and cooling the refrigerant. Also included is an evaporator for evaporating refrigerant and cooling another fluid and returning the refrigerant to the compressor inlet. A phase separator is interposed between the heat exchanger and the evaporator for receiving cool refrigerant from the heat exchanger. The phase separator includes a chamber having an inlet connected to the heat exchanger, an upper vapor outlet adapted to be connected to the compressor inlet for delivering a vapor stream thereto and a liquid refrigerant outlet at a first level in a lower part of the chamber and connected to the evaporator. The phase separator also includes a lubricant outlet at a second level in the lower part of the chamber which is different from the first level. A lubricant conduit is connected to the lubricant outlet and to the compressor inlet for delivering lubricant separated in the phase separator to the compressor to lubricate the same by discharging lubricant into the vapor stream. Also included is a bypass conduit connected to the vapor outlet and to the compressor inlet to deliver the vapor stream to the compressor.

In a highly preferred embodiment, the lubricant conduit terminates in an eductor located in one of the vapor outlet and the bypass conduit.

In an even more preferred embodiment, the lubricant conduit is a capillary conduit having one end located in the chamber and serving as the lubricant outlet and an opposite end located in the vapor outlet serving as the eductor.

In one embodiment, the lubricant outlet is located below the liquid refrigerant outlet.

In an even more preferred embodiment of the system, the same includes a suction line heat exchanger having first and second flow paths in heat exchange relation with one another. The first flow path connects the heat exchanger and the phase separator and the second flow path connects the bypass conduit and the evaporator to the compressor inlet.

Other objects and advantages will become apparent from the following specification taken in connection with the accompanying drawings.

DESCRIPTION OF THE DRAWINGS

FIG. 1 is a schematic of a refrigeration system made according to the invention; and FIG. 2 is an enlarged sectional view of a phase separator made according to the invention.

DESCRIPTION OF THE PREFERRED EMBODIMENTS

A preferred embodiment of a refrigeration system made according to the invention is illustrated in the drawings and will be described as a system operating with conventional refrigerant as, for example, R134a or any of the commercially and environmentally acceptable refrigerants sold under the trademark FREON®. However, it is to be understood that the system can be employed advantageously in other vapor compression systems using other refrigerants. It may also be used as part of a vapor compression system utilizing atranscritical fluid as a refrigerant as, for example, carbon dioxide. No limitation to any particular type of refrigerant, whether conventional or transcritical, is intended except insofar as expressed in the appended claims.

Referring to FIG. 1, the system includes a compressor 10 having an inlet 12 and an outlet 14. The outlet 14 is connected to a heat exchanger 16. In a system using conventional refrigerants, the heat exchanger 16 will be a condenser whereas if the system is employing transcritical refrigerants such as carbon dioxide, it will serve as a gas cooler. In the usual case, the gas cooler/condenser 16 will cool the compressed refrigerant received from the compressor outlet 14 by passing ambient air through the heat exchanger 16 in heat exchange relation with the compressed refrigerant. The refrigerant will thus be cooled and/or condensed and will exit an outlet 18 of the heat exchanger as a high pressure fluid.

The heat exchanger outlet 18 is connected to one flow path of a suction line heat exchanger 20 and enters the same at an inlet 22. The suction line heat exchanger 20 is optional and is more apt to be used in a transcritical refrigerant system than in one employing conventional refrigerants. However, it may be employed in both. The high pressure refrigerant exits the suction line heat exchanger via an outlet 24, still at high pressure but cooled further within the suction line heat exchanger 20. In this regard. refrigerant vapor enters the suction line heat exchanger 20 at an inlet 26 to exit at an outlet 30. The inlet 26 and outlet 30 are connected by a second flow path within the suction line heat exchanger 20 which is in heat exchange relation with the first flow path that extends between the inlet 22 and the outlet 24. As illustrated, the flow is counterflow but cross flow or concurrent flow may be employed in some instances.

The cooled refrigerant exiting the outlet 24 of the suction line heat exchanger 20 is then passed to an orifice 32 and discharged into an inlet 34 of a phase separator 36. The phase separator 36, as will be explained in greater detail hereinafter, separates the incoming refrigerant into three different fractions. A first is a gas or vapor phase which exits at an outlet 38. A second is a liquid phase which exits at an outlet 40. The phase separator 36 also acts to separate the usual lubricant contained in the refrigerant from the liquid phase 40 and direct it to the outlet 38.

The outlet 38 is connected to a bypass conduit 42 which includes a conventional expansion valve 44. The liquid phase refrigerant 40 exits the phase separator 36 to enter an inlet 46 for one flow path of an evaporator 48. The evaporator refrigerant flow path includes an outlet 50 which is joined to the bypass conduit 42 at a junction 52 and then to the inlet 26 for the suction line heat exchanger. The evaporator 48 additionally includes a second flow path in heat exchange relation with the one just described through which a fluid media passes to be cooled within the evaporator. In some instances, as in air conditioning systems, this fluid media will be ambient air. In other instances, the fluid media could be a liquid such as brine or the like.

The purpose of the phase separator 36 is, as mentioned previously, to separate liquid refrigerant and gaseous refrigerant and bypass the latter around the evaporator 48. As is well known, to achieve a desired degree of cooling of the media cooled in the evaporator 48, a given mass flow rate of refrigerant through the evaporator must occur. For a given mass flow rate of the refrigerant (quality being defined by the percentage of the refrigerant in the gaseous or vapor phase with the quality of 100 being a flow of gas or vapor with no liquid and a quality of zero being a flow of all liquid and no vapor or gas), the higher the quality, the greater the velocity of the fluid through the evaporator 48 because of the difference in densities between the vapor or gas on the one hand and the liquid on the other. All other things being equal, higher refrigerant velocities in the evaporator 48 mean a greater pressure drop across the evaporator 48. As is well known, excessive pressure drops in refrigeration systems are to be avoided. Consequently, in order to avoid high pressure drops, it is necessary that the passages within the evaporator interconnecting the inlet 46 and outlet 50 be made larger for higher refrigerant quality flows. This, of course, increases the size of the evaporator 48 as well as increases the cost in terms of the materials that must be employed therein.

Through the use of the phase separator 36, the vast majority of vapor and/or gaseous refrigerant bypasses the evaporator with the result being that the refrigerant quality passing through the evaporator 48 is lower than would otherwise be the case. This in turn reduces pressure drop and allows minimization of the size of the evaporator 48.

The quality of refrigerant entering the evaporator from the phase separator can be closely regulated through the use of the expansion valve 44 which typically would respond to the temperature of the refrigerant at a desired point in the system.

One problem accompanies the use of such a system. As is well known, the refrigerants employed in systems of this sort typically include a lubricant for lubricating the compressor 10 during its operation. The lubricant typically will travel with the liquid phase refrigerant because of its relatively high density. In some instances, the lubricant may have a density greater than that of the liquid refrigerant while in others, it may be less than that of the liquid refrigerant.

When the mass flow of gas through the bypass conduit 42 is high, the flow of refrigerant exiting the evaporator 48 at the outlet 50 will typically be diminished which, in turn, will mean that the content of lubricant in the stream being returned to the compressor inlet 12 will be reduced.

Furthermore, it is desirable that a lubricant within the evaporator 48 be avoided entirely because of its poor thermal conductivity which, in turn, reduces efficiency of the evaporator 48.

FIG. 2 illustrates one construction of the phase separator 36 that is designed to both assure a constant stream of lubricant to the compressor inlet 12 while minimizing or eliminating the passage of lubricant to the evaporator 48. While it is illustrated as one that is useful in systems where the lubricant has a greater density than the liquid refrigerant, as explained in greater detail hereinafter, it is useful where the converse is true, i.e., the lubricant has a lesser density than that of the liquid refrigerant.

The phase separator includes a housing 60 defining a chamber 62. The chamber 62 may be of any desired configuration so long as the desired separation can be achieved therein. The inlet 34 will typically, but not always, be toward the upper end of the chamber 62 while the vapor or gas outlet 38 will be at the upper end of the chamber 62 or at least near the upper end of the chamber 62.

On the other hand, the outlet 40 will be near the lower end of the chamber.

As illustrated in FIG. 2, a body of separated lubricant 64 has an upper level at 66. Above the lubricant 64 is a body 68 of liquid refrigerant having an upper level 70 which is below the vapor or gas outlet 38. The outlet 40 includes a standpipe or the like that extends inwardly into the chamber 64 to a point above the lubricant level 66 and below the liquid refrigerant level 70 so as to provide an outlet opening 72 within the body 68 of liquid refrigerant for withdrawing the same from the phase separator and passing it to the inlet 46 of the evaporator 48.

Also included is a capillary tube 74 having an upper end 76 and a lower end 78. It will be observed that the lower end 78 of the capillary tube 74 is below the lubricant level 66 and within the body of lubricant 64. Conversely, the upper end 76 of the capillary tube 74 extends into the outlet 38.

In operation, refrigerant exiting the orifice 32 will enter the chamber 62 in the direction shown by an arrow 80. Because of the difference in densities, the refrigerant will separate into gaseous refrigerant above the level 70 and liquid refrigerant below the level 70. In addition, for the situation where the refrigerant 68 is less dense than the body 64 of lubricant, the lubricating oil will separate out at the level 66. This level is, as mentioned previously, above the lower open end 78 of the capillary tube 74. Consequently, refrigerant vapor passing through the outlet 38 will pass by the upper end 76 of the capillary tube 74 and draw lubricant through the capillary tube 74 out of the end 76 where it is discharged into the vapor stream passing from the outlet 38 ultimately to the junction 52. From there it will pass with refrigerant through the suction line heat exchanger 20 and ultimately to the inlet 12 of the compressor 10. It will be immediately appreciated that the upper end 76 of the capillary tube 74 serves as an eductor for lubricant into the vapor stream as long as vapor is passing from the inlet 34 to the outlet 38 and to the compressor inlet 12. When such is not occurring, lubricant will not be educted through the end 76 but during such a situation, the compressor 10 will not be operating.

In some instances, the lubricant may have a lesser density than the density of the liquid refrigerant. The phase separator of the invention is useful in that situation as well. It is only necessary to locate the open upper end 72 at a lower position within the chamber 62 than the end 78 of the capillary tube 74 such that the latter will be located within the body of lubricant holding on the body of liquid refrigerant and the outlet 40 will have the end 72 disposed in the body of liquid refrigerant.

It will accordingly be appreciated that the invention provides a system whereby high pressure losses encountered in the evaporator 48 are limited through the use of the bypass line 42. At the same time, adequate lubrication of the compressor 10 is achieved as a result of the eduction of lubricant from the phase separator 36 into the vapor stream that is being passed to the compressor inlet 12. Further, the system avoids or minimizes the passage of lubricant into the evaporator 48 whereat it would have interfered with the operation of the evaporator 48. Consequently, system efficiency is maximized, both through the elimination of inordinately high pressure drops within the evaporator 48 and the avoiding of the passing of lubricant to the evaporator 48.

I claim:

1. A refrigeration system comprising:

a compressor having an inlet and an outlet;

a heat exchanger for receiving compressed, lubricant containing refrigerant from the compressor outlet and cooling the refrigerant;

an evaporator for evaporating refrigerant and cooling another fluid and returning the refrigerant to the compressor inlet;

a phase separator interposed between the heat exchanger and the evaporator for receiving cooled refrigerant from the heat exchanger, said phase separator including a chamber having an inlet connected to the heat exchanger, an upper vapor outlet adapted to be connected to the compressor inlet for delivering a vapor stream thereto, a liquid refrigerant outlet at a first level in a lower part of the chamber and connected to the evaporator, and a lubricant outlet at a second level in the lower part of the chamber different from said first level;

lubricant conduit connected to said lubricant outlet and to the compressor inlet for delivering lubricant separated in the phase separator to the compressor to lubricate the same by discharging lubricant into said vapor stream; and a bypass conduit connected to said vapor outlet and to said compressor inlet to deliver said vapor stream to said compressor.

2. The refrigeration system of claim 1 wherein said lubricant conduit terminates in an eductor located in one of said vapor outlet and said bypass conduit.

3. The refrigeration system of claim 2 wherein said lubricant conduit is a capillary conduit having one end located in said chamber and serving as said lubricant outlet and an opposite end located in said vapor outlet serving as said eductor.

4. The refrigeration system of claim 1 wherein said lubricant outlet is below said liquid refrigerant outlet.

5. The refrigeration system of claim 1 further including a suction line heat exchanger having first and second flow paths in heat exchange relation with one another, said first flow path connecting said heat exchanger and said phase separator and said second flow path connecting said bypass conduit and said evaporator to said compressor inlet.

6. A refrigeration system comprising:

a compressor having an inlet and an outlet;

a condenser/gas cooler connected to said compressor outlet to receive lubricant containing, compressed refrigerant therefrom and condense/cool the same;

an evaporator having a first flow path for a fluid media to be cooled in heat exchange relation with a second flow path for the condensed/cooled refrigerant;

an expansion device interconnecting said condenser/gas cooler and said second flow path;

a phase separator interposed between said expansion device and said second flow path including a refrigerant inlet connected to said expansion device, a refrigerant vapor outlet, a liquid refrigerant outlet and a lubricant outlet and operating on differences in density between refrigerant vapor, liquid refrigerant and lubricant to separate refrigerant entering said refrigerant inlet into a refrigerant vapor stream, a refrigerant liquid stream and a lubricant stream, said refrigerant liquid outlet being connected to said second flow path;

a bypass conduit connecting said refrigerant vapor outlet to said compressor inlet to deliver said refrigerant vapor stream thereto; and a lubricant conduit connected to said lubricant outlet and to one of said bypass conduit and said refrigerant vapor outlet for delivering lubricant to said refrigerant vapor stream.

7. The refrigeration system of claim 6 wherein said lubricant conduit terminates in an eductor in said one of said bypass conduit and said refrigerant vapor outlet.

8. The refrigeration system of claim 7 wherein said eductor is in said refrigerant vapor outlet.

9. The refrigeration system of claim 8 wherein said eductor includes a capillary tube.

10. The refrigeration system of claim 9 wherein said capillary tube additionally serves as said lubricant conduit.

11. The refrigeration system of claim 6 wherein said phase separator includes at least one separator chamber.

12. The refrigeration system of claim 11 wherein said refrigerant vapor outlet includes a port in said chamber above both said liquid refrigerant and lubricant outlets and said refrigerant liquid and lubricant outlet are at differing vertical positions within said chamber.

13. The refrigeration system of claim 6 including a suction line heat exchanger having one flow path interconnecting said condenser/gas cooler and said expansion device and another flow path in heat exchange relation with said one flow path and connecting both said second flow path and said bypass conduit to said compressor inlet.

* * * * *